US011980928B2

(12) United States Patent
Ruch et al.

(10) Patent No.: US 11,980,928 B2
(45) Date of Patent: May 14, 2024

(54) PRESSING TOOL WITH A DRIVE CONTROLLED BASED ON RECORDED PRESSING DATA

(71) Applicant: Von ARX AG, Sissach (CH)

(72) Inventors: Matthias Ruch, Efringen-Kirchen (DE); Rudolf Kreuzer, Buchs (CH)

(73) Assignee: Emerson Professional Tools AG, Sissach (CH)

( * ) Notice: Subject to any disclaimer, the term of this patent is extended or adjusted under 35 U.S.C. 154(b) by 422 days.

(21) Appl. No.: 16/561,718

(22) Filed: Sep. 5, 2019

(65) Prior Publication Data

US 2020/0078844 A1 Mar. 12, 2020

(30) Foreign Application Priority Data

Sep. 6, 2018 (EP) ..... 18192953

(51) Int. Cl.
*B21D 7/06* (2006.01)
*B21C 51/00* (2006.01)

(52) U.S. Cl.
CPC ..... *B21D 7/06* (2013.01); *B21C 51/00* (2013.01)

(58) Field of Classification Search
CPC ..... B21D 7/06; B21C 51/00; B25B 27/10
See application file for complete search history.

(56) References Cited

U.S. PATENT DOCUMENTS

2017/0087709 A1* 3/2017 Barezzani ..... B25B 27/10

FOREIGN PATENT DOCUMENTS

| | | | |
|---|---|---|---|
| CN | 101754836 | A | 6/2010 |
| CN | 106470805 | A | 3/2017 |
| DE | 102008024018 | | 11/2008 |
| DE | 102013203553 | | 7/2014 |
| DE | 102013219159 | | 11/2014 |
| EP | 3299126 | A1 | 3/2018 |
| WO | WO2016005838 | A1 | 1/2016 |
| WO | WO2016198973 | A1 | 12/2016 |

OTHER PUBLICATIONS

Office action dated Nov. 5, 2021; Patent Application No. EP 18192953.0; 7 pages.
Chinese office action dated Jul. 21, 2021; Patent Application No. No. 201910841830X; 8 pages.
Chinese office action dated Dec. 3, 2020; Patent Application No. No. 201910841830X; 8 pages.
European Search Report dated Apr. 29, 2019; Patent Application No. 18192953.0; 10 pages.

* cited by examiner

*Primary Examiner* — Teresa M Ekiert
(74) *Attorney, Agent, or Firm* — Mark Bandy; Rankin Hill & Clark, LLP

(57) ABSTRACT

A pressing tool for plastically deforming a tubular workpiece, and particularly a fitting is described. The pressing tool comprises pressing jaws, a drive adapted to drive the pressing jaws in order to apply a force to the workpiece, a sensor system which is adapted to record a set of pressing data during a pressing process and a control which is adapted to control the drive based on the recorded set of pressing data. Also described are related methods, pressing jaws and workpieces.

20 Claims, 3 Drawing Sheets

PRESSING TOOL WITH A DRIVE CONTROLLED BASED ON RECORDED PRESSING DATA

FIELD

The present invention relates to a pressing tool for plastically deforming a tubular workpiece, and particularly a fitting. Further, the invention relates to a method of operating such a pressing tool, pressing jaws to couple to a pressing tool as well as a tubular workpiece, and particularly a fitting.

BACKGROUND

Several methods of joining tubular workpieces are known in prior art. For example, pipes may be soldered or welded together. Furthermore, putting the end of a smaller pipe into one end of a larger pipe and subsequently pressing the two pipes against each other is known. In other cases, pressing is carried out using a (compression) fitting. For this purpose, pressing tools, such as pipe pressing tools, may be used in order to join a pipe to a compression fitting. Such a fitting may be designed as a piping and plumbing fitting that may be used as an adapter in a pipe, for example. A fitting may be made from various materials such as copper, aluminum, plastics, composite material and/or (stainless) steel.

A (tube) pressing tool may comprise pressing jaws made from metals such as steel, aluminum or the like, for example, which may be interchangeable. Furthermore, the pressing tool may comprise exchangeable pressing pliers which feature the pressing jaws. Other pressing jaw assemblies comprising pressing jaws are known as well. By means of the pressing jaws and/or the pressing jaw assembly, a force may be applied to the fitting in order to plastically deform the latter in such a manner that the fitting abuts a pipe as closely, tightly and firmly as possible. When using such a pressing tool, the pressing jaws may be pressed together in order to press a fitting arranged between them around a pipe. The pressing tool may be hand-held and be operated by a drive. Typically, electrical and/or hydraulic drives are used.

Typically, the pressing jaws and/or pressing jaw assemblies are workpiece-specific. For example, for pressing metal fittings such as copper or (stainless) steel fittings, different pressing jaws/pressing jaw assemblies are used than when plastic fittings pressed. The pressing tool may be adapted for different workpieces, particularly fittings, by exchanging the pressing jaws/pressing jaw assemblies. When such conventional pressing tools are used, the maximum pressing force is usually always applied during pressing, independently of the pressing jaws actually used and/or pressing jaw assembly and/or fittings actually used and/or fittings actually used. However, this may be disadvantageous because the pressing force required for pressing plastic fittings, for example, is much smaller than that required for pressing metal fittings. Hence, applying the maximum pressing force leads to an unnecessary waste of energy and may result in damage in the fitting and pipes to be joined, as the case may be.

Additionally, each type of pressing jaws used and/or pressing jaw assemblies used features characteristic pressing characteristics. For example, the pressing characteristics may depend on the mechanical advantage of the pressing jaw assembly, the material of the pressing jaws and the workpiece to be pressed. For example, a workpiece such as a fitting made from steel, should be pressed differently than a fitting made from plastics, also in order to guarantee a positive joint and a long durability of the pressed fitting as optimal as possible, for example. Additionally, the pressing processes are different for fittings with different dimensions as, during the pressing process with a fitting of a smaller diameter, for example, the pressing jaws engage with the fitting later.

Thus, the problem that underlies the present invention is to press a fitting against a pipe in a manner that is as optimal and material-friendly as possible. Particularly, an improved (pipe) pressing tool is to be provided which makes such pressing possible. These and other problems which will become apparent for the person skilled in the art from the following description are solved by a pressing tool as described herein, a method of operating a pressing tool as described herein, pressing jaws as described herein and a tubular workpiece as described herein.

SUMMARY

The difficulties and drawbacks associated with previous approaches are addressed in the present subject matter as follows.

In one aspect, the present invention provides a pressing tool for plastically deforming a tubular workpiece. The pressing tool comprises pressing jaws and a drive adapted to drive the pressing jaws in order to apply a force to the workpiece. The pressing tool also comprises a sensor system which is adapted to record a set of pressing data during a pressing process. And, the pressing tool comprises a control which is adapted to control the drive based on the recorded set of pressing data.

In another aspect, the present invention provides a method of operating a pressing tool for plastically deforming a tubular workpiece. The method comprises providing a pressing tool including pressing jaws, a drive adapted to drive the pressing jaws in order to apply a force to the workpiece, a sensor system which is adapted to record a set of pressing data during a pressing process, and a control which is adapted to control the drive based on the recorded set of pressing data. The method also comprises engaging the pressing jaws with the workpiece. The method further comprises applying force to the surface of the engaged workpiece by means of the pressing jaws. The method also comprises recording a set of pressing data during the pressing process. And, the method comprises controlling the drive based on the recorded set of pressing data.

In yet another aspect, the present invention provides pressing jaws to couple to a pressing tool for plastically deforming a tubular workpiece. The pressing jaws provide a suitable set of pressing data.

In still another aspect, the present invention provides a tubular workpiece for pressing by a pressing tool. The tubular workpiece provides a set of pressing data.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
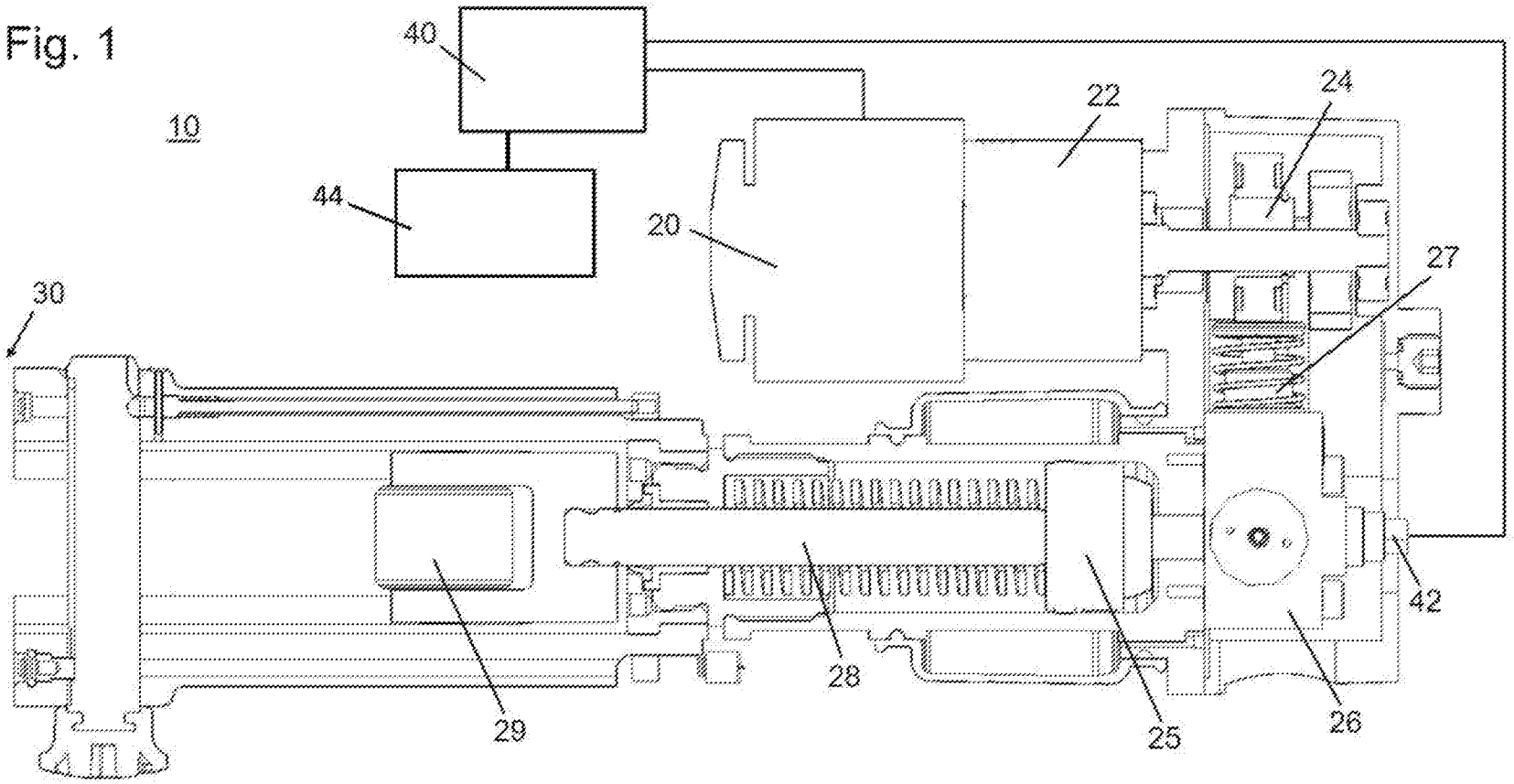
FIG. 1 shows a schematic illustration of an embodiment of the pressing tool as a hydraulic hand-held pressing device according to the present invention.

The present invention relates to a pressing tool for plastically deforming a tubular workpiece, and particularly a fitting. The pressing tool comprises pressing jaws, a drive adapted to drive the pressing jaws in order to apply a force to the workpiece, a sensor system which is adapted to record a set of pressing data during a pressing process, and a control which is adapted to control the drive based on the recorded set of pressing data. The tubular workpiece may be a fitting, for example, which is pressed against two pipes in order to join the latter together. The fitting may be made, for example, from copper, aluminum, plastics, composite material and/or (stainless) steel, at least partially. The pressing tool, in turn, may be adapted to plastically deform such a tubular workpiece such as a fitting, for example, in such a manner that it is joined with a part of a pipe arranged in the fitting. In particular, by means of the pressing tool, pressing may be performed in order to inseparably join together a fitting and a pipe by a positive and/or force-closed joint. For example, the fitting may be specified according to the standard DIN EN 1254-7. The pressing jaws may be movable relative to each other and may be closed and spread apart, for example, so that a tubular workpiece may be arranged between the pressing jaws in the spread state, for example. The pressing jaws may be interchangeable and comprise jaws for pressing, crimping or cutting. For example, the pressing tool may comprise two pressing jaws. The drive may comprise an electric motor, a pneumatic and/or a hydraulic drive unit as well as a transmission. By means of the drive, the pressing jaws of the pressing jaw assembly may be moved relative to each other in order to be driven into the closed state, for example. Here, the drive may provide at least some of the force that is necessary to deform the tubular workpiece, for example for joining a fitting to a part of a tube. For this purpose, the drive may be directly coupled to the pressing jaws or coupled to the pressing jaws via a transmission in order to transmit the motive power to the pressing jaws. The force acting upon the pressing jaws may be variably set here by correspondingly varying the motor parameters or other parameters (such as transmission settings), for example. Here, the set of pressing data comprises at least two pressing data values, wherein pressing data may be a pressing pressure or a pressing force, for example, which are applied to the fitting by the pressing jaws. The pressing pressure may also be indirectly determined by sensors via the electricity intake or power intake of the mode. In the course of the pressing process, the pressing data may vary as time progresses during the pressing process. Additionally, the pressing data may vary with respect to a stroke length of a servo piston. The stroke length of the servo piston may be derived from the motor speed, for example. The motor speed per time yields the strokes of the pump piston, which allows for the amount of pumped oil to be determined and the fill level of the working cylinder to be calculated on this basis. In this way, the path of the servo piston may be determined. The person skilled in the art appreciates that the present invention is not limited to the parameters mentioned above but that any suitable measurand that suitably characterizes the pressing process of the pressing tool for plastically deforming a workpiece during pressing is comprised. In this context, the set of pressing data may be recorded from an initial state, e.g. with pressing jaws spread apart to a maximum degree, to a final state, in which the pressing jaws are entirely closed and the workpiece, thus, is completely plastically deformed. Additionally, the set of pressing data may be recorded starting at a later point in time during the pressing process and/or the recording may be terminated at an earlier point in time before completion of the pressing process. What is required for this is that the recorded set of pressing data is suitable for characterizing the pressing process and, thus, facilitates a correspondingly adapted control of the drive. For this purpose, the sensor system may comprise corresponding sensing means, for example one or more sensor(s), which determine the pressing data mentioned above. The sensor system may further comprise corresponding means for analysis which may be embodied by means of a processor and/or memory with corresponding program code, for example. In this context, the sensing means may be provided at the pressing tool separately of the means for analysis. Here, the sensor system may be supplied via an energy source arranged at the pressing tool which may also supply energy to the drive. The sensor system may be adapted to transmit or provide the set of pressing data to the control so that the drive may be correspondingly controlled. The sensor system may be activated or deactivated by a user by means of a switch, for example, in order to activate or deactivate a control of the drive based on the recorded set of pressing data. Here, the recorded pressing data may depend on the pressing jaws used or the workpiece, e.g. the fitting, which means that different pressing data is obtained during the pressing process, depending on the geometric arrangement or material. Hence, the control of the drive may be optimally adapted to a certain workpiece and/or certain pressing jaws. In this way, the pressing tool may apply an individual pressing force by means of the drive in order to achieve an optimal and material-friendly deformation of the workpiece. In this context, the use of the sensor system makes an automatic identification of the pressing jaws and/or the workpiece possible, which, for example, makes an automatic adaptation of the control of the drive during operation possible, which means that the operator of the pressing tool themselves do not have to manually provide any input and, accordingly, are not additionally burdened. In this way, the risk of occupational stress may be reduced. The present invention may be used in the field of electrical engineering, for example in pressing, cutting and punching. Furthermore, controlling the drive according to the invention may comprise switching off the drive, which saves energy and prevents an unnecessary application of force to the workpiece by the pressing jaws. In this way, both the pressed workpiece and the pressing tool according to the invention may be spared wear and tear.

Further preferably, the pressing tool comprises a storage medium with a database which comprises at least one stored set of pressing data for a pressing process. Such data may relate to at least one kind of pressing jaws and/or at least one kind of tubular workpieces. Here, the database may include sets of pressing data for one or more kind(s) of pressing jaws and/or kinds of workpieces. The kinds of the stored data for pressing jaws and workpieces are typically information regarding their geometrical design or their material, for example. Combinations of such data may be used. In this context, the storage medium may also be modularly coupled to the pressing tool. This means that, depending on which tubular workpieces and/or pressing jaws are used, different storage media with one or more stored set(s) of pressing data may be provided for corresponding pressing processes. For example, accessing the database via a (wired or wireless) interface in order to update the content of the database, for example, is possible.

Further preferably, the pressing tool comprises the control being adapted to compare the recorded set of pressing data to the at least one stored set of pressing data and to control the drive based on the recorded set of pressing data if the at least one recorded set of pressing data is allocated to a corresponding stored set of pressing data. The storage medium may include corresponding control parameters for controlling the pressing tool which are allocated to corresponding sets of pressing data. The pressing data included in the database may be compared to the set of pressing data recorded by the sensor system so that the drive may be correspondingly controlled in case of correspondence of a set of pressing data. Thus, the drive may already be suitably controlled during the pressing process according to the pressing jaws and/or workpieces used and recognized by the sensor system. Additionally, the parameters suitable for controlling the pressing tool which were determined based on the recorded set of pressing data may also be provided to a user, which means that they may subsequently be manually adjusted by a user. If the recorded set of pressing data and a stored set of pressing data do not correspond to each other, an allocation between of the recorded set of pressing data to the stored set of pressing data may not take place. Then, the drive may be controlled according to different preset parameters so that safe pressing is ensured even if the pressing jaws and/or the workpiece is/are not recognized.

Further preferably, the pressing tool comprises that the database comprises at least one specific control parameter for controlling the drive, wherein the at least one specific control parameter is allocated to a corresponding stored set of pressing data, wherein the at least one specific control parameter comprises pressing parameters, particularly a maximum pressing force, a pressing path and/or a pressing duration and/or wherein the at least one specific control parameter comprises drive parameters, particularly an output speed, power output and/or an oil pressure. Combinations of these parameters may be used. The control parameters from the database may be accordingly used in order to operate the drive. For example, control parameters for stainless-steel fittings and different control parameters for copper fittings may be stored in the database. Depending on whether corresponding fittings and/or corresponding pressing jaws were recognized by means of the sensor system, the corresponding control parameters may be loaded from the database and be used by the control in order to control the drive and, ultimately, the pressing tool. Here, for different characteristics of the pressing tool (e.g. mechanical advantage, kind of the pressing jaws, size of the workpiece to be pressed, material of the workpiece to be pressed and/or shape of the workpiece to be pressed), corresponding control parameters may be stored in the database in order to make optimal pressing or deforming of the respective workpiece possible. Thus, depending on the kind of pressing jaw assembly and/or the kind of workpiece to be pressed by means of the pressing jaw assembly, for example certain pressing forces, pressing speeds, pressing paths and/or pressing durations that are to be used by the pressing tool for pressing or deforming the fitting together with a part of the pipe, for example, may be preset. For example, said parameters may be preset in the form of a pressing curve which defines a time curve of the pressing force, pressing path and/or pressing speed. Here, the person skilled in the art appreciates that corresponding control parameters need to be stored in the database, according to the intended purpose of the pressing tool. Moreover, different drive parameters may be stored in the database, which parameters may be loaded based on identified pressing jaw assembly in order to ultimately deform the (identified) workpiece. The person skilled in the art appreciates that the pressing parameters or drive parameters may comprise motor and/or transmission parameters which may control the transmission of force from the drive to the pressing jaws.

Further preferably, the pressing tool comprises the drive being controlled based on the at least one specific control parameter if the at least one recorded set of pressing data is allocated to at least one corresponding stored set of pressing data. Thus, the pressing tool may be specifically controlled based on the determined pressing data so that using general, unspecific control parameters, i.e. control parameters that are independent of the workpiece and/or pressing jaws used is not necessary. This may prevent that an unnecessarily high amount of pressing force or pressing pressure is applied to the workpiece or that the pressing process takes an unnecessarily long amount of time.

Further preferably, the pressing tool comprises the drive being adapted to be controlled based on unspecific control parameters if the at least one recorded set of pressing data is not allocated to at least one corresponding stored sets of pressing data, wherein the at least one unspecific control parameter comprises pressing parameters, particularly a maximum pressing force, a pressing path and/or a pressing duration and/or wherein the at least one specific control parameter comprises drive parameters, particularly an output speed, power output and/or an oil pressure. For example, the unspecific control parameters may be defined in such a manner that safe pressing is ensured irrespective of the pressing jaws used and/or the workpiece to be pressed. Furthermore, the pressing tool may be adapted in such a manner that it is controlled based on unspecific control parameters if no parameters are present from the sensor system for controlling the control, for example. It may also be provided that a user may select whether or not the pressing tool should use the specific control parameters according to the pressing parameters recorded. The person skilled in the art appreciates that what was said with respect to the pressing parameters of the specific control parameters above accordingly applies to the pressing parameters of the unspecific control parameters.

Further preferably, the pressing tool comprises that the sensor system is adapted for feature recognition of characteristic features of the pressing jaws and/or the workpiece, particularly for recognizing characteristic geometrical and/or material-specific features based on the recorded set of pressing data. For example, a shape and/or size of the workpiece and/or of the pressing jaws used may be recognized by means of the sensor system. Based on said characteristic features, at least the kind of workpiece may be identified, and, subsequently, the motor may be accordingly controlled in order to optimally deform the workpiece. Certain geometrical features of workpieces and pressing jaws may be associated with sets of pressing data in this context which means that certain characteristic features of pressing jaws and workpieces are allocated to certain sets of pressing data. This may make the use of different combinations of materials and/or geometric features of the workpieces and pressing jaws for several consecutive pressing processes possible without requiring any manual input by a user for controlling the pressing tool. Hence, an optimal deformation of the workpiece under the corresponding conditions of the pressing jaws used and/or the workpiece used is made possible in each pressing process.

Further preferably, the pressing tool comprises a protocol storage which is adapted to store the sensor data and control data. In this manner, the deformation process may be configured to be trackable. All or some data on the deformation process may be stored in the protocol storage in order to make quality control of individual deformations possible as well. Access to the protocol storage is possible via a (wireless or wired) interface for reading the corresponding data.

Further preferably, the pressing tool comprises that the at least one recorded set of pressing data represents a first pressing curve and wherein the at least one stored set of pressing data represents a second pressing curve and wherein the shapes of the first and of the second pressing curve are examined as to correspondence and wherein the drive is controlled according to the stored set of pressing data in case of correspondence of the first and second pressing curve if the first pressing curve corresponds to the second pressing curve. Thus, the pressing tool is adapted to compare an actual pressing curve to a stored pressing curve. Based on the comparison, the workpiece used and/or the pressing jaws used may subsequently be identified. In this context, the pressing curve may result from a time curve of the pressure in the working cylinder during the pressing process or from the curve of the pressure with respect to a traveled path of the servo piston of the pressing tool, for example. The person skilled in the art knows a plurality of suitable methods of comparing the pressing curves, for example by comparing the recorded data points at various waypoints of the servo piston, forming derivations from the pressing curve and determining and comparing gradients of the pressing curve, for example by means of common software.

Further preferably, the pressing tool may be a hydraulic or mechanical hand-held pressing device driven electrically. By means of a hand-held pressing device, pressing may flexibly take place at various sites of application such as a construction site. Here, electrically driven pressing devices may apply high pressing forces which ensure reliable pressing. In a hydraulic hand-held pressing device, for example, a hydraulic pressure of up to approximately 550 bar may be applied, which directly acts upon the workpiece enclosed by the pressing jaws.

Furthermore, the present invention comprises a method of operating the pressing tool according to the invention for plastically deforming a tubular workpiece, and particularly a fitting. The method comprises engaging the pressing jaws engaging with the workpiece and applying a force to the surface of the engaged workpiece by means of the pressing jaws, recording a set of pressing data during the pressing process and controlling the drive based on the recorded set of pressing data. For the purpose of applying the required force, the drive of the pressing tool may be accordingly controlled. In this context, the control is dependent on the recorded set of pressing data. The drive may be correspondingly controlled during pressing or it may also be accordingly controlled based on sets of pressing data previously recorded. Hence, depending on the recorded set of pressing data, a suitable reduced or increased pressing force may be provided.

Further preferably, the method comprises that a plastic deformation of the workpiece is determined during the pressing process based on the recorded set of data, wherein the controlling comprises stopping the motor if it is determined that a plastic deformation of the workpiece no longer takes place. This may ensure that no unnecessary force is applied to the workpiece by the pressing jaws when a plastic deformation no longer takes place. It reduces the pressing duration, saves energy and may protect the workpiece to be pressed from damage by excessive pressing pressure.

Further preferably, the method comprises that the drive defines an initial and a final position, wherein the drive is driven into the opposite direction, after the motor has been stopped, in order to return it to the initial position. Thus, after the completed pressing process, the pressing tool is again present at the initial position, which makes faster pressing possible in case of multiple pressing processes, for example for multiple workpieces, as the pressing tool always is in the initial state prior to the pressing process.

Furthermore, the present invention relates to pressing jaws to couple to the pressing tool according to the invention for plastically deforming a tubular workpiece, particularly a fitting, wherein the pressing jaws are suitable for providing a suitable set of pressing data. Furthermore, the present invention relates to a tubular workpiece, particularly a fitting, for pressing by the pressing tool according to the invention, wherein the tubular workpiece is suitable for providing a suitable set of pressing data. This means that the pressing jaws and/or the tubular workpiece may be suitable for suitable sets of pressing data being generated so that comparable pressing data may be generated for a repeated use of the same pressing jaws and/or workpieces. In this context, the sets of pressing data generated by the pressing jaws according to the invention and/or the workpiece according to the invention may have a predefined maximum error tolerance so that drawing conclusions as to the used pressing jaws and/or the workpiece to be pressed from the generated pressing data is possible with a correspondingly high probability.

FIG. 1 shows an embodiment of a hydraulic hand-held pressing device and/or a pressing tool 10 with a hydraulic power transmission unit. In said hydraulic hand-held pressing device, a motor 20 drives an eccentric 24 via a transmission 22 to which said eccentric 24 is coupled. Preferably, motor 20 is a brushless motor which is supplied with electricity modulated accordingly from a rechargeable battery or wired power supply (not shown) by a control 40. Transmission 22 reduces the speed of motor 20 and increases the torque. Eccentric 24 coupled to the transmission transforms the rotary motion of the output shaft of transmission 22 into a one-dimensional oscillating motion in order to drive a piston pump 27 of hydraulic system 26. Due to its motion, piston pump 27 pumps a hydraulic fluid from a reservoir to a working cylinder 25 which causes the hydraulic pressure in working cylinder 25 to rise. The rising hydraulic pressure presses a piston 28 that is movably guided in the cylinder according to the illustration of FIG. 1 to the left, towards attachment area 30 for interchangeable pressing jaws (not shown in detail). Due to the use of a large piston diameter, piston 28 is able to transmit very high pressures to the pressing jaws. Piston 28 is mechanically connected to rollers 29 which move together with the motion of piston 28. Rollers 29 move in the usual manner between suitable ends of pressing jaws which, thus, are closed and may plastically deform the workpiece with a large force. During operation, the hydraulic pressure thus is directly proportionally transmitted to the coupled pressing jaws and applies a pressing force to the workpiece that is directly proportional to the hydraulic pressure. Due to the hydraulic pressure rising during pressing and, thus, due to the increasing pressing force upon the workpiece and/or the fitting, the workpiece is pressed and plastically deformed. By means of a measurement of the hydraulic pressure, the pressing force at the workpiece may be determined. The hydraulic pressure in hydraulic system 26 may easily be measured by means of a pressure sensor 42. Pressure sensor 42 transmits the measured pressure signal to control 40 via signal lines or by means of wireless communication using corresponding radio transmission. Wireless signal transmission means such as common digital wireless connections such as Bluetooth, NFC or the like, may be used, for example. Analogue signals of pressure sensor 42 may be converted into digital signals in an ND converter so that they may be analyzed by digital control 40. For this purpose, control 40 has at least one digital computational unit such as a microcontroller, DSP, FPGA, ASIC or the like. Furthermore, a database 44 is provided in which predetermined values which are required for analysis and control may be retrieved which is coupled to control 40. Depending on the results of the analysis, control 40 emits corresponding control signals to motor 20 via power electronics (not shown). Motor 20 is controlled with the aid of said control signals in order to operate it at a certain controlled speed and to stop it at the end of the pressing process.

In a different embodiment that is not illustrated, the pressing tool may also be designed as a purely mechanical hand-held pressing device with a mechanical power transmission unit. In a mechanical hand-held pressing device, a motor generates a rotary motion which is transmitted to at least one mechanical power transmission unit such as a linkage or leadscrew via a transmission. The mechanical power transmission unit converts the rotary motion into a linear motion which, according to hydraulic hand-held pressing device 10 of FIG. 1 described above, displaces rollers with a large force which move the pressing jaws. Due to the increasing force of the pressing jaws, a workpiece such as a fitting which is disposed between the pressing jaws is plastically deformed. Force sensors for measuring the force transmitted to the tool from the motor may be arranged at different positions in the mechanical hand-held pressing device in order to measure a force that is proportional to the pressing force and signal it to the control. Furthermore, the electricity taken in by motor 20 is also proportional to the motor torque and, thus, to the pressing force at the pressing jaws.

Figure 2:
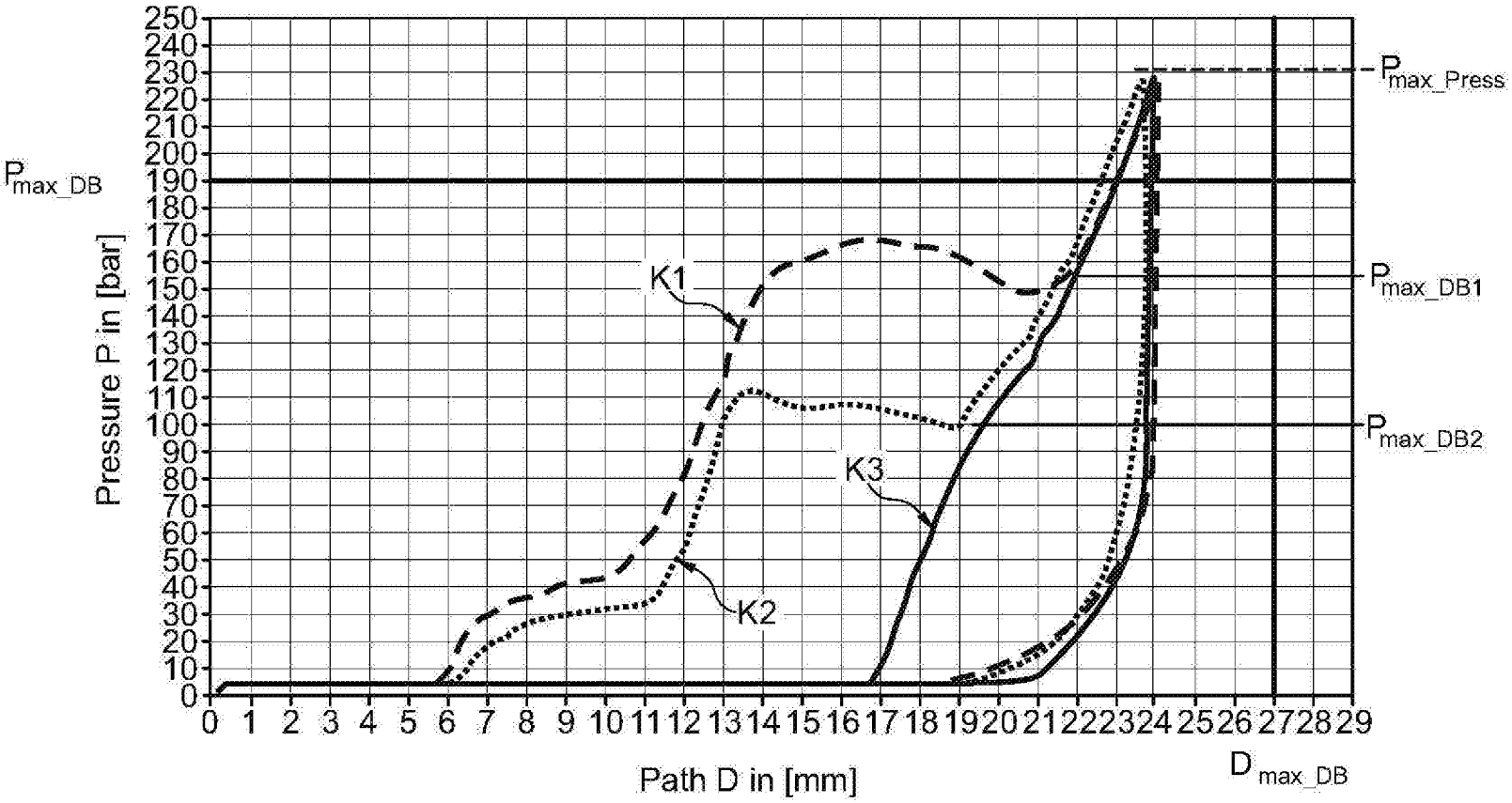
FIG. 2 shows a diagram of pressing parameter curves for different materials to be pressed of a first fitting for a pressing tool according to prior art.
Figure 3:
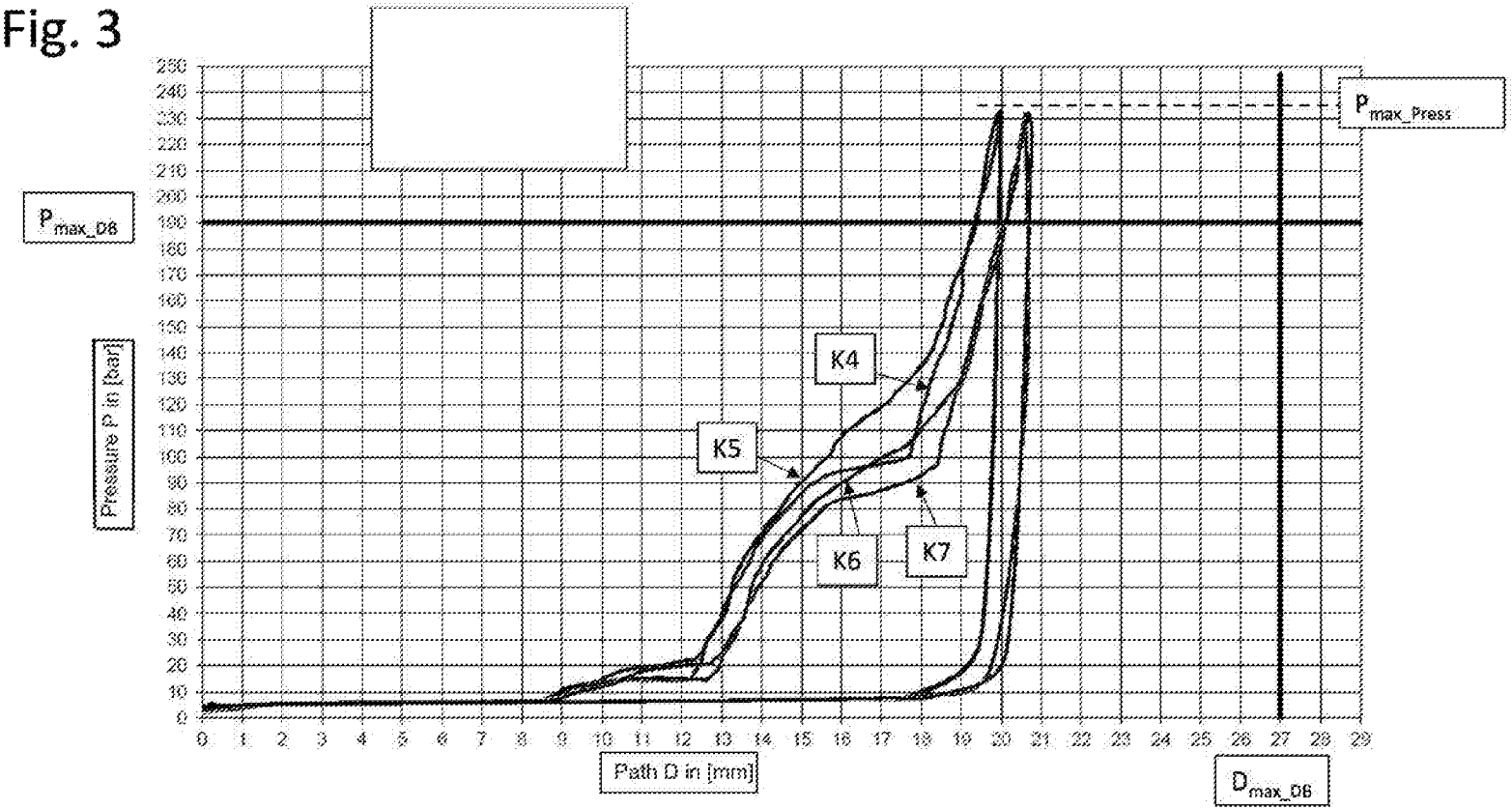
FIG. 3 shows a diagram of pressing parameter curves for different materials to be pressed of a second fitting for a pressing tool according to prior art.

FIGS. 2 and 3 show pressing curves K1 through K7 for different fittings each, made from different materials and of different sizes. Each pressing curve describes the pressing pressure P applied to the fitting depending on the stroke length D traveled by the servo piston. FIG. 2 shows pressing curves of a fitting with a diameter of 22 mm, wherein K1 represents the pressing curve for a fitting which is made from stainless steel (INOX) and wherein the curve K2 represents the pressing curve for a fitting consists of copper. K3 represents a pressing process without fitting. Here, the pressing jaws are closed as the pressure rises. When curve K1 and/or K2 has the same gradient as pressure increases as curve K3 does, this indicates that the fitting is maximally deformed and the pressing jaws are closed. This point of complete deformation of the individual fittings is illustrated as Pmax_DB1 or Pmax_DB2 in FIG. 2. The pressing curves K4 through K7 of FIG. 3 show the pressure curve during the pressing of plastics fittings with a diameter of 18 mm. As shown in FIGS. 2 and 3, the rise in pressure for the smaller fitting with a diameter of 18 mm only starts at a stroke length of about 9 mm, whereas the rise in pressure for the larger fitting with a diameter of 22 mm takes place earlier, namely at a stroke length of about 6 mm. In case of larger fittings, the jaws contact the surface of the fitting earlier, which is why the pressing process and, thus, the increase in pressure in the working cylinder, begins earlier, i.e. when the servo piston has only traveled a few millimeters. Furthermore, Dmax_DB represents a value for the maximum stroke length stored in the database, Pmax_DB represents a value for the maximum pressure stored in the database. Furthermore, Pmax_Press represents a maximum value for a pressure which may be applied by means of the pressing tool according to prior art. Suitable pressing would already be achieved at corresponding pressures Pmax_DB1, Pmax_DB2 or Pmax_DB, but the pressing tool of prior art generates pressure beyond said value. According to the invention, when a certain pressure curve is recognized, the pressing process is controlled in such a manner that pressure is only generated until the predetermined value Pmax_DB is reached. Subsequently, the motor is stopped and the servo piston is returned to its initial position. In this manner, the motor may be stopped earlier so that only a reduced maximum pressure Pmax_DB has to be applied during the pressing process for complete pressing.

LIST OF REFERENCE SIGNS

10 Pressing tool
20 Motor
22 Transmission
24 Eccentric
25 Working cylinder
26 Hydraulic system
27 Piston pump
28 Piston
29 Rollers
30 Attachment area for interchangeable tools
40 Control
42 Pressure sensor
44 Database
K1-K7 Pressing curves Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A pressing tool for plastically deforming a tubular workpiece, particularly a fitting, the pressing tool comprising:

pressing jaws;

a drive for driving the pressing jaws in order to apply a force to the workpiece;

a sensor system for recording a set of pressing data during a pressing process;

a control for automatically controlling the drive;

a storage medium with a database which comprises at least one stored set of pressing data for a pressing process, wherein the at least one recorded set of pressing data represents a first pressing curve and wherein the at least one stored set of pressing data represents a second pressing curve; and wherein the control is configured to compare shapes of the first pressing curve and the second pressing curve with each other to automatically identify at least one of the workpiece and the pressing jaws.

2. The pressing tool according to claim 1, wherein the at least one stored set of pressing data is selected from data relating to press jaws, data relating to workpieces, and combinations thereof.

3. The pressing tool according to claim 1, wherein the control compares the recorded set of pressing data to the at least one stored set of pressing data and controls the drive based on the recorded set of pressing data if the at least one recorded set of pressing data is allocated to at least one corresponding stored set of pressing data.

4. The pressing tool according to claim 1, wherein the database comprises at least one specific control parameter for controlling the drive, wherein the at least one specific control parameter is allocated to a corresponding stored set of pressure data, wherein the at least one specific control parameter comprises at least one of a pressing parameter and a drive parameter.

5. The pressing tool according to claim 4, wherein the drive is controlled based on the at least one specific control parameter if the at least one recorded set of pressing data is allocated to at least one corresponding stored set of pressing data.

6. The pressing tool according to claim 5, wherein the drive is controlled based on unspecific control parameters if the at least one recorded set of pressing data is not allocated to at least one corresponding stored set of pressing data, wherein the at least one unspecific control parameter comprises at least one of a pressing parameter and a drive parameter.

7. The pressing tool of claim 4 wherein the pressing parameter is selected from the group consisting of a maximum pressing force, a pressing path, a pressing duration, and combinations thereof.

8. The pressing tool of claim 4 wherein the drive parameter is selected from the group consisting of an output speed, a power output, an oil pressure, and combinations thereof.

9. The pressing tool according to claim 1, wherein the sensor system recognizes characteristic features of the pressing jaws and/or the workpiece.

10. The pressing tool of claim 9 wherein the characteristic features of the pressing jaws and/or the workpiece are geometrical features based on the recorded set of pressing data.

11. The pressing tool of claim 9 wherein the characteristic features of the pressing jaws and/or the workpiece are material-specific features based on the recorded set of pressing data.

12. The pressing tool according to claim 1, further comprising a protocol storage which stores sensor data and/or control data.

13. The pressing tool according to claim 1, wherein the pressing tool is an electrically driven hydraulic or mechanical hand-held pressing device.

14. A method of operating a pressing tool for plastically deforming a tubular workpiece, the pressing tool including pressing jaws, and a drive, the method comprising:

engaging of pressing jaws with the workpiece; and applying force to a surface of the engaged workpiece by means of the pressing jaws;

recording by a control a set of pressing data during a pressing process, wherein the recorded set of pressing data represents a first pressing curve having a first shape and wherein an at least one stored set of pressing data represents a second pressing curve having a second shape;

comparing by the control, the first and second shapes of the first and second pressing curves with each other to automatically identify at least one of the workpiece and the pressing jaws.

15. The method according to claim 14, wherein the pressing tool further includes and a motor, the drive defining an initial and a final position, wherein the method further comprises controlling the drive including moving the drive in an opposite direction, after the motor has been stopped, in order to return the drive to an initial position.

16. The method of claim 14 wherein the workpiece is a fitting.

17. The method of claim 14 wherein the at least one stored set of pressing data is selected from data relating to press jaws, data relating to workpieces, and combinations thereof.

18. The method of claim 14 wherein the pressing tool further includes a storage medium with a database.

19. The method of claim 18 wherein the database comprises at least one specific control parameter for controlling the drive.

20. The method of claim 14 wherein the pressing tool further includes a sensor system for the recording.

* * * * *